US008563093B2

(12) United States Patent
Osamura et al.

(10) Patent No.: US 8,563,093 B2
(45) Date of Patent: Oct. 22, 2013

(54) METHOD FOR PRODUCTION OF ELECTROLESS PLATING MATERIAL

(75) Inventors: Manabu Osamura, Kariya (JP); Toshihisa Shimo, Kariya (JP); Kyoko Kumagai, Kariya (JP); Isami Kato, Kariya (JP); Takeshi Bessho, Toyota (JP); Takeaki Maeda, Osaka (JP)

(73) Assignees: Toyota Jidosha Kabushiki Kaisha, Aichi-ken (JP); Okuno Chemical Industries Co., Ltd., Osaka (JP)

( * ) Notice: Subject to any disclaimer, the term of this patent is extended or adjusted under 35 U.S.C. 154(b) by 200 days.

(21) Appl. No.: 12/881,524

(22) Filed: Sep. 14, 2010

(65) Prior Publication Data

US 2011/0064889 A1 Mar. 17, 2011

(30) Foreign Application Priority Data

Sep. 17, 2009 (JP) ..... 2009-216005

(51) Int. Cl.

| | |
|---|---|
| ***B05D 3/04*** | (2006.01) |
| ***B05D 3/00*** | (2006.01) |
| ***C08J 7/18*** | (2006.01) |
| ***G21H 5/00*** | (2006.01) |

(52) U.S. Cl.

USPC ..... 427/553; 427/307; 427/322

(58) Field of Classification Search

USPC ..... 205/167, 168, 169, 205, 210, 211; 427/307, 322, 535, 536, 539, 553

See application file for complete search history.

(56) References Cited

U.S. PATENT DOCUMENTS

| | | | | |
|---|---|---|---|---|
| 4,505,786 | A * | 3/1985 | Birkmaier et al. | 205/50 |
| 5,340,451 | A | 8/1994 | Buchwalter et al. | |
| 5,534,297 | A * | 7/1996 | Ogisu et al. | 427/322 |
| 6,555,835 | B1 * | 4/2003 | Wydeven | 250/504 R |
| 6,645,557 | B2 * | 11/2003 | Joshi | 427/304 |
| 2007/0110973 | A1 * | 5/2007 | Hiraoka et al. | 428/220 |

FOREIGN PATENT DOCUMENTS

| | | | |
|---|---|---|---|
| CN | 1875130 | A | 12/2006 |
| JP | 01-92377 | A | 4/1989 |
| JP | 04-234437 | A | 8/1992 |
| JP | 2002-309377 | A | 10/2002 |
| JP | 2003-201571 | A | 7/2003 |
| JP | 2004-031583 | A | 1/2004 |
| JP | 2004-131807 | A | 4/2004 |
| JP | 2004-186661 | A | 7/2004 |
| JP | 2004-315894 | A | 11/2004 |

(Continued)

OTHER PUBLICATIONS

Japanese Office Action dated Oct. 20, 2011 in Japanese Application No. 2009-216005.

(Continued)

*Primary Examiner* — Michael Wieczorek

(74) *Attorney, Agent, or Firm* — Sughrue Mion, PLLC

(57) ABSTRACT

A production method of an electroless plating material of the present invention is a method for the production of an electroless plating material that has a surface to be plated by electroless plating, and includes an ozone treatment step in which a material body that is made of a resin is brought into contact with a solution that contains ozone to form a modified layer in a surface of the material body, and a superficial layer removal step in which, after the ozone treatment step, the surface of the material body is irradiated with ultraviolet rays to remove a superficial layer of the modified layer.

14 Claims, 5 Drawing Sheets

(56) References Cited

FOREIGN PATENT DOCUMENTS

| | | | |
|---|---|---|---|
| JP | 2005-36292 | A | 2/2005 |
| JP | 2005-042029 | A | 2/2005 |
| JP | 2005-113236 | A | 4/2005 |
| JP | 2005-194611 | A | 7/2005 |
| JP | 2005-281762 | A | 10/2005 |
| JP | 2006-057166 | A | 3/2006 |
| JP | 2007-231362 | A | 9/2007 |
| JP | 2007-308791 | A | 11/2007 |
| JP | 2008-094923 | A | 4/2008 |
| JP | 2008-513599 | A | 5/2008 |
| JP | 2008-156702 | A | 7/2008 |
| JP | 2009-24244 | A | 2/2009 |
| WO | WO 2006/029642 | A1 | 3/2006 |

OTHER PUBLICATIONS

Chinese Office Action for corresponding CN Patent Application No. 201010285441.2 issued on May 3, 2012.

* cited by examiner

METHOD FOR PRODUCTION OF ELECTROLESS PLATING MATERIAL

INCORPORATION BY REFERENCE

The disclosure of Japanese Patent Application No. 2009-216005 filed on Sep. 17, 2009, including the specification, drawings and abstract is incorporated herein by reference in its entirety.

BACKGROUND OF THE INVENTION

1. Field of the Invention

The present invention relates to a method for production of an electroless plating material that is used for forming a plating film on its resin surface by an electroless plating treatment.

2. Description of the Related Art

Resin materials are expected to be used in a wide variety of fields because of their characteristics such as high formability, high degree of freedom for characteristic values such as strength, and light weight. However, resins also have disadvantages such as lack of electrical conductivity and low hardness. Thus, for the purpose of compensating for the disadvantages of resin materials, resins are combined with other materials such as metals. For example, one well-known method for imparting electrical conductivity to a resin is to form an electrically-conductive film such as metal film on a surface of the resin. Above all, chemical plating (electroless plating) can form an electrically-conductive film easily and inexpensively as compared with other methods for forming an electrically-conductive film. Electroless plating is a process where a metal film is formed on a material surface by chemically reducing and depositing metal ions in a solution. In contrast to electrolytic plating in which a metal film is formed by electrodeposition that is induced by electricity power, a metal film can be formed even on insulating materials such as resins. In addition, resin materials with a metal film formed thereon can be further subjected to electrolytic plating and can therefore be used in a wide variety of applications. Thus, the electroless plating treatment is widely used as a method for imparting electrical conductivity or metallic luster to resin materials for use in the fields of automobile parts, electric appliances and so on.

However, the films formed by electroless plating have problems because it takes a long time to form the films and because the adhesion of the films to resin materials is not sufficient. Thus, a pretreatment is often applied to resin materials prior to the electroless plating treatment.

As a pretreatment to improve adhesion, roughening of a resin material surface by chemical etching is typically carried out for the purpose of improving adhesion strength between the resin material and the plating film by an anchor effect. However, the method of surface roughening by chemical etching not only decreases the surface smoothness, but also poses a problem in terms of disposal of waste liquid because toxic and deleterious substances such as chromic acid, permanganic acid, and sulfuric acid are used.

Accordingly, an electroless plating film is formed after a surface of the resin material has been modified by bringing the resin material with ozone water (ozone water treatment) in Japanese Patent Application Publication No. 2005-36292 (JP-A-2005-36292), Japanese Patent Application Publication No. 2005-113236 (JP-A-2005-113236) and Japanese Patent Application Publication No. 2009-24244 (JP-A-2009-24244). When a resin material is brought into contact with ozone water, molecular chains such as double bonds are broken by oxidation by ozone in a surface of the resin material and polar groups such as OH groups, CO groups, and COOH groups are formed in the surface. When a resin material that has many polar groups in its surface is subjected to electroless plating, a plating film that has excellent adhesion strength can be formed. In addition, when the ozone water penetrates into a surface region of the resin material, a layer that has pores of below nano-level is formed in the surface of the resin. When electroless plating is carried out on such a surface of the resin material, the plating solution penetrates even into the pores. Since metal ions are deposited in the pores to form a mixed layer composed of the resin and metal in the surface region of the resin material, a nano-level anchor effect may be achieved.

In the above documents, the surface of the resin material is subjected to, in addition to an ozone water treatment, ultraviolet irradiation. It is said to be preferred to carry out the ultraviolet irradiation simultaneously with the ozone water treatment because the surface of the resin material is activated and polar groups are formed by a synergetic effect of ultraviolet rays and ozone.

As with the above, a surface treatment is carried out using a solution that contains an alkaline component after a treatment of the resin material using ozone water for the purpose of exposing a large number of polar groups to the surface of a resin material. When a solution that contains an alkaline component is used, however, there is caused a problem that the resin material is not dissolved or the resin is so soluble that it is dissolved more than necessary and, worse yet, the resin material itself is deteriorated depending on the combination of the alkali and resin that are used. In addition, a surface treatment of a resin material using a solution that contains an alkaline component is equivalent to the chemical etching that is described above and is apt to decrease the smoothness of the surface of the resin material.

That is, the treatment with the alkaline component just activates a surface of a resin material to form a large number of polar groups so that the plating treatment can be carried out on the surface of the resin material with high adhesion. No evaluation has been made on the adhesion strength in resin materials that have been left to stand in a severe environment after the plating treatment.

The adhesion of an electroless plating film to a flat resin surface can be achieved even by a mere treatment of the resin material with ozone water prior to the electroless plating treatment. However, the result of a durability test that was conducted on such electroless plating coated members reveals that incidents of peeling of electroless plating films significantly increases when they have been left to stand in a high-temperature and high-humidity environment. Thus, reliability that ensures that the coated members may be used even in an environment where a high-temperature and high-humidity condition is likely to be established is required.

SUMMARY OF THE INVENTION

It is, therefore, an object of the present invention to provide a method for the production of an electroless plating material that can solve the problem of a reduction in the adhesion strength between a resin material and an electroless plating film that may occur in a high-temperature and high-humidity environment.

The present inventors conducted various evaluations on electroless plating coated members that were obtained by subjecting a resin material to an electroless plating treatment after an ozone water treatment. As a result, the fact was noticed that peeling of an electroless plating film that is caused in a high-temperature and high-humidity environment does not occur at the interface between the resin material and the electroless plating film but can result from fracture of a superficial layer of the resin material (a mixed layer of the resin and metal). This is believed to be because a surface region of the resin material that has been modified by the ozone water treatment undergoes a reduction in strength when exposed to a high-temperature and high-humidity environment. Then, the present inventors have developed the finding and accomplished the invention that is described below.

A method for the production of an electroless plating member according to an aspect of the present invention includes: an ozone treatment step in which a material body that is made of a resin is brought into contact with a solution that contains ozone to form a modified layer in a surface of the material body; a superficial layer removal step in which, after the ozone treatment step, a superficial layer of the modified layer is removed; and a plating step in which, after the superficial layer removal step, the surface of the material body is plated by electroless plating. Examples of a method of removing a superficial layer of the modified layer includes irradiation of ultraviolet rays to the surface of the material body, plasma processing, flame treatment, etching processing using acid solution, etc.

In this specification, "electroless plating" may be occasionally referred to simply as "plating."

It is believed that the outline of the method for the production of an electroless plating material according to the present invention can be schematically illustrated as shown in FIG. 1. FIG. 1 is a cross-sectional view that schematically illustrates the material body before and after each step of the method for the production of an electroless plating material according to the present invention. According to the method for the production of an electroless plating material of the present invention, a portion of a modified layer that is formed in a surface of the material body that is made of a resin in an ozone treatment step, has been removed in a superficial layer removal step. The superficial layer that is removed in the superficial layer removal step would provide a site that can be an origin of peeling of the electroless plating film in a high-temperature and high-humidity environment. Since such a superficial layer is removed prior to an electroless plating treatment, the adhesion strength of the electroless plating is improved. Also, it is only the superficial layer of the modified layer that is removed in the superficial layer removal step. Thus, it is expected that when the electroless plating material is subjected to the electroless plating treatment, a nano-level anchor effect develops by a mixed layer that is composed of the resin and metal and is formed by deposition of metal ions in pores that the modified layer has. As a result, the adhesion strength at the interface between the material body and the electroless plating film is maintained at a high level.

It should be noted that a "high-temperature" referred to in this specification can be defined as 50° C. or higher, more specifically 85° C. or higher. Also, a "high-humidity" referred to in this specification can be defined as a relative humidity of 60% or higher, more specifically 85% or higher.

When the removal of the superficial layer is achieved by ultraviolet irradiation onto the surface of the modified layer, the material body is maintained smooth. Also, the removal of the superficial layer proceeds because molecular chains of the resin that constitutes the material body are broken by the ultraviolet irradiation. Such breakage of molecular chains is independent of the type of the resin. At this time, the adhesion of the electroless plating film to the electroless plating material increases because polar groups are formed in the surface of the electroless plating material.

It should be noted the term "smooth" referred to in this specification means that the material body has a surface roughness Rz of 3 μm or less, more specifically 1 μm or less, in ten point average roughness (JIS), which corresponds to ISO 4287:1997. When surface roughening by chemical etching is done to obtain a macro-level anchor effect, it is a general practice to treat the material body so as to have a surface roughness Rz of 5 μm or more.

In the method for the production of an electroless plating material according to the present invention, the modified layer that is formed in the ozone treatment step preferably has a thickness of 30 to 200 nm. When the modified layer is formed so as to have a thickness in an appropriate range, sufficient adhesion strength is obtained between the resin material and the electroless plating film even in a high-temperature and high-humidity environment.

Also, in the method for the production of an electroless plating material according to the present invention, the superficial layer removal step is preferably a step in which the surface of the modified layer is removed by a thickness of 0.1 T (nm) or more and 0.5 T (nm) or less, where T represent the thickness (nm) of the modified layer. When the thickness of the superficial layer that is removed in the superficial layer removal step is in an appropriate range, a nano-level anchor effect develops with the strength of the modified layer maintained even in a high-temperature high-humidity environment.

The ultraviolet irradiation is simple because an existing ultraviolet source can be used. Molecular chains in the surface of the material body are broken by the energy of ultraviolet rays. In addition, since the thickness of the superficial layer to be removed can be controlled by adjusting the ultraviolet irradiation conditions, the thickness of the superficial layer to be removed can be easily changed based on the thickness of the modified layer. Also, when the superficial layer removal step is carried out in an oxidative atmosphere, the superficial layer is properly removed by oxidation.

According to the method for the production of an electroless plating of the present invention, it is possible to reduce a decrease in adhesion strength between a resin material and an electroless plating film that occurs in a high-temperature and high-humidity environment.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
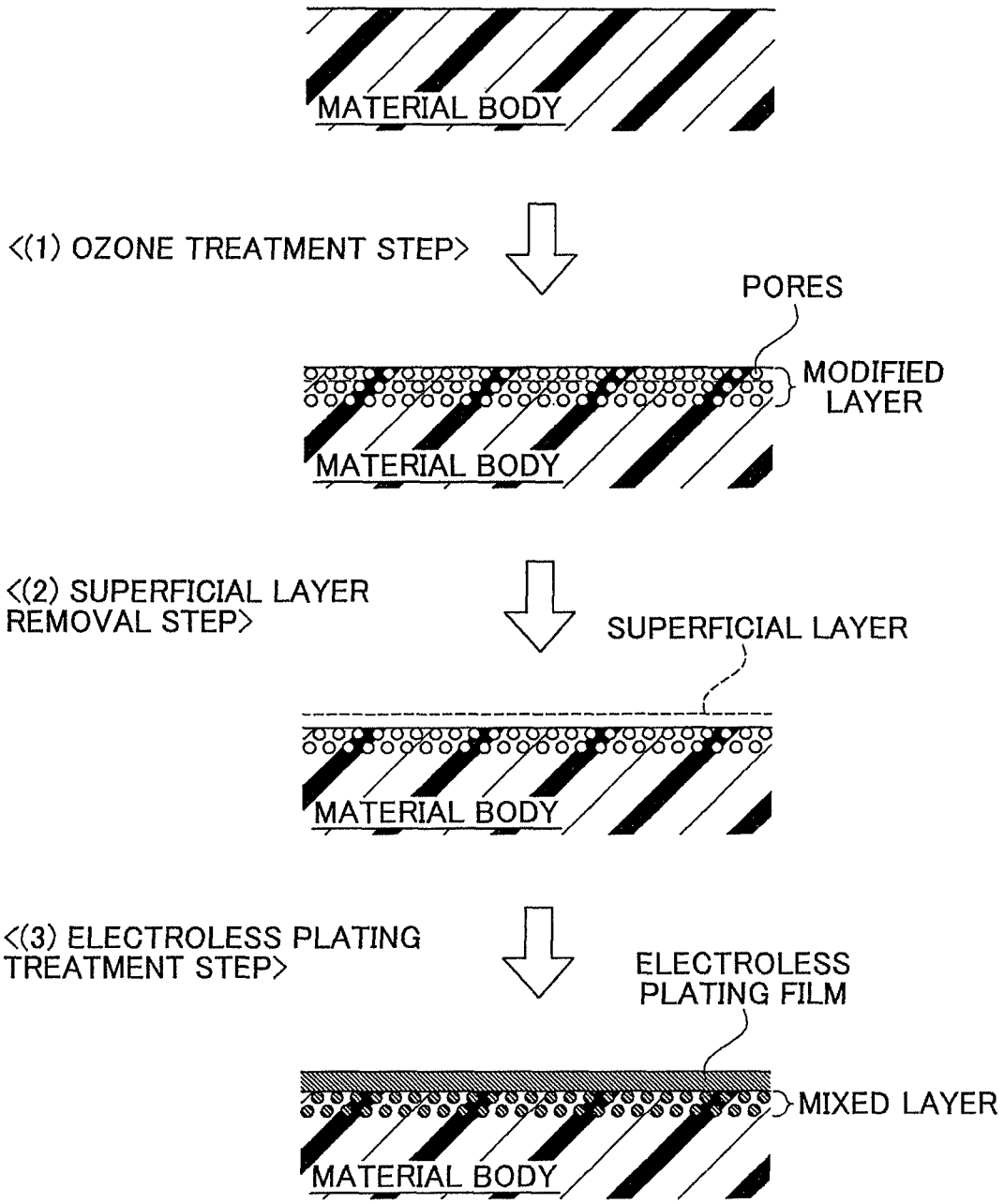
FIG. 1 is a schematic view that illustrates the outline of a method for the production of an electroless plating material according to the present invention.

Unless otherwise specified, a range of values in the form of "x to y" that is shown in this specification includes both the lower limit x and upper limit y of the range. Further, at least one of the lower limit x and the upper limit y may be changed to any one of values listed in Examples.

A method for the production of an electroless plating material of the present invention primarily includes an ozone treatment step and a surface removal step. An electroless plating material refers to a resin material that is to be subjected to electroless plating to form a plating film on its surface. Each of these steps is described below.

The ozone treatment step is a step in which a material body that is made of a resin and a solution that contains ozone are brought into contact with each other to form a modified layer in a surface of the material body. The material body may be formed of a various types of resins such as thermoplastic resins, thermosetting resins, and mixtures of both. Examples of the thermosetting resin include an epoxy resin, a cyanate resin, a phenol resin, a melamine resin, a urea resin, and an unsaturated polyester resin. Examples of the thermoplastic resin include a polyethylene resin, a polypropylene, polystyrene, ABS, AS, a polyacetal resin, a polyester resin, a polyether resin, a polyimide resin, a polyamide-imide resin, a polyetherimide resin, a polysulfone resin, a polyethersulfone resin, a polyphenylene ether resin, a polycarbonate resin, a polyether ether ketone resin, and a polyester resin. It is effective to apply the present invention to an epoxy resin, a cyanate resin, a cycloolefin resin or a polyimide resin that has significantly reduced adhesion in a high-temperature and high-humidity environment. Further, the material body may be formed of a composite material that additionally contains an inorganic filler or the like.

The shape of the material body is not specifically limited, and a material body that has been formed into a prescribed shape by press molding, injection molding, blow molding or the like can be used. When the ozone treatment step and the surface removal step are wished to be performed on only a portion of the material body, masking may be suitably provided on the material body.

While the solution for use in the ozone treatment step usually uses water as a solvent, an organic or inorganic polar solvent may be used as the solvent. Examples of the organic polar solvent include: alcohols such as methanol, ethanol, and isopropyl alcohol; N,N-dimethylformamide; N,N-dimethylacetamide; dimethylsulfoxide; N-methylpyrrolidone; hexamethylphosphoramide; organic acids such as formic acid and acetic acid; and mixed solvents of these solvents with water or alcohol-type solvents. Examples of the inorganic polar solvent include inorganic acids such as nitric acid, hydrochloric acid, and hydrofluoric acid.

An ozone solution is obtained by dissolving ozone into the above solvent under pressure. The ozone concentration in the ozone solution has an influence upon the thickness of the modified layer that will be formed in a surface of the material body and upon the degree of activation of the surface. When expressed relative to the total amount of the ozone solution that is taken as 100% by mass, an ozone concentration of about 10 ppm is effective in surface activation but an ozone concentration of 20 ppm or more and even of 40 ppm or more greatly increases the activation effect and allows a rapid treatment. However, when the concentration is higher than 100 ppm, the ozone concentration tends to be inconsistent because of non-uniformity of the liquid flow in the bath of the ozone solution, which makes it difficult to treat the material body uniformly. The ozone concentration is therefore preferably 100 ppm or less.

The higher treatment temperature in the ozone treatment step increases the reaction rate. However, the higher temperature decreases the solubility of ozone and the ozone concentration in the ozone solution. Therefore, the treatment temperature is preferably 10 to 40° C. The time of contact between the ozone solution and the material body, which is dependent on the concentration of the ozone solution and the type of the resin of the material body, is preferably 3 to 30 minutes. A contact time of less than 3 minutes makes it difficult for the effect of ozone treatment to develop even with an ozone concentration of 40 ppm or more, and a contact time of more than 30 minutes may cause deterioration of the resin substrate. By carrying out the ozone treatment step under these conditions, a modified layer with a thickness of approximately 30 to 200 nm can be formed.

A modified layer thickness of 30 nm or more is preferred because adhesion strength between the plating material and the electroless plating film can be sufficiently high. To impart insulation properties to the plating material, a portion of the plating film may be removed from the plated plating material by etching. A modified layer thickness greater than 200 nm is not preferred because the plating that has penetrated into the modified layer after the plating cannot be sufficiently removed by etching, which results in poor insulation properties. The thickness of the modified layer is more preferably 60 to 200 nm, and much more preferably 90 to 150 nm.

Examples of the method for bringing the material body into contact with the ozone solution include immersion of the material body into the ozone solution and application of the ozone solution onto the material body. Immersion of the resin substrate into the ozone solution is preferred because ozone is less likely to be released from the ozone solution as compared with application by, for example, spraying. As a result of the ozone treatment step, a modified layer is formed in a surface of the material body. The modified layer is a layer that has pores of below nano-level. By oxidation by ozone in the ozone solution, polar groups such as OH groups, CO groups, and COOH groups are formed in the surface of the modified layer. Also, polar groups are formed in surfaces of the pores.

A drying step may be carried out after the ozone treatment step. The drying step is a step to remove the ozone solution that has adhered to the material body after the ozone treatment step. This is because when a large amount of ozone solution remains on the material body, it may attenuate the energy which will be applied in the next superficial layer removal step or may cause damages to devices that will be used in the superficial layer removal step. However, because the material body spontaneously dries when left to stand in the open air for 5 minutes or longer even when the ozone water is an aqueous solution, it is not necessarily to raise the temperature to dry the material body.

The superficial layer removal step is a step to remove a superficial layer of the modified layer by irradiating a surface of the material body with ultraviolet rays after the ozone treatment step. The ultraviolet rays to be irradiated preferably have a wavelength of 350 nm or less, more preferably 300 nm or less, much more preferably about 150 to about 260 nm. The amount of ultraviolet irradiation is preferably 8 to 22 $W/cm^2$. The irradiation time is preferably 1 to 40 minutes. As a light source that can emit such ultraviolet rays, a low-pressure mercury lamp, a high-pressure mercury lamp, an excimer laser, a barrier discharge lamp, or a microwave electrodeless discharge lamp can be used.

The ultraviolet irradiation is preferably carried out in the presence of oxygen such as in air or in an oxygen atmosphere. This is because generation of active oxygen is promoted by the energy of the ultraviolet rays and the superficial layer is oxidized and removed by the active oxygen. Such ultraviolet irradiation in an oxidative atmosphere is also preferred because a large number of polar groups are formed in the surface of the modified layer.

The conditions for the ultraviolet irradiation may be properly selected based on the type of the material body and the amount of the superficial layer to be removed. To determine the amount of the superficial layer to be removed, an electroless plating treatment is carried out on a material body that has been subjected only to an ozone treatment, and the resulting electroless plating coated member is left to stand in a high-temperature and a high-humidity environment that is close to or more severe than the intended environment of use, for a prescribed period of time. After that, a peeling test is conducted. By observing the cross-section where peeling occurred, the location where fracture can start in the mixed layer (i.e., modified layer) can be predicted. It is preferred that a superficial layer with a thickness that is equal to the distance from the surface of the modified layer to the predicted location should be removed in the superficial layer removal step.

If the thickness to be removed in the superficial layer removal step should be specifically defined, the thickness from the surface of the modified layer is preferably 0.1 T (nm) or more and 0.5 T (nm) or less, more preferably 0.2 T (nm) or more and 0.4 T (nm) or less, much more preferably 0.25 T (nm) or more and 0.35 T (nm) or less, where T represents the thickness (nm) of the modified layer. When the thickness is less than 0.1 T (nm), the mixed layer is swelled and tends to be the origin of peeling of the electroless plating film under high-temperature and high-pressure conditions, resulting in poor adhesion strength. When the thickness is more than 0.5 T (nm), a sufficient nano-level anchor effect cannot be obtained and peeling tends to occur at the interface between the material body and the electroless plating film. In this case, the thickness T is preferably in the range of 30 to 200 nm, more preferably in the range of 60 to 200 nm, much more preferably in the range of 90 to 150 nm. When the thickness T is 30 nm or more and even 60 nm or more, the appropriate range for the thickness of the superficial layer to be removed in the superficial layer removal step can be wider and the thickness to be removed can be easily controlled. However, an excessively large thickness T is not preferred because the thickness of the superficial layer to be removed in the superficial layer removal step can be too large to remove completely. More specifically, the thickness of the superficial layer to be removed is 10 to 50 nm, preferably 20 to 40 nm, more preferably 25 to 35 nm, when the modified layer has a thickness of approximately 100 nm (90 to 110 nm, for example).

The electroless plating material that is obtained by the method for the production of an electroless plating material according to the present invention is subjected to an electroless plating treatment step. A pretreatment step that is carried out on the electroless plating material before the electroless plating treatment, and the succeeding electroless plating treatment step are described below.

It is preferred to carry out, before the electroless plating treatment step, a surface cleaning step in which the electroless plating material is brought into contact with a solution that contains at least an alkaline component and/or a surfactant. The alkaline component makes only a surface region of the modified layer in the electroless plating material water-soluble on the molecular level. At this time, the alkaline component helps formation of an increased number of polar groups in the surface of the modified layer. The type of the alkaline component is not specifically limited, and sodium hydroxide, potassium hydroxide, lithium hydroxide and so on can be used. Also, by applying a surfactant to the surface of the modified layer, the surface tension of the plating solution is reduced to improve the wettability of the surface. In the surface cleaning step, it is preferable to use a cleaner conditioner solution that is conventionally and widely used as a solution that contains an alkaline component and a surfactant. The time of contact between the cleaner conditioner solution and the modified layer, which is not specifically limited, is preferably 1 to 10 minutes. When the time of contact is too short, the amount of surfactant that adsorbs to the polar groups may be insufficient. However, when the time of contact is too long, the alkaline component may roughen the surface of the modified layer. Also, while the time of contact can be shorter as the contact temperature is higher, a contact temperature of 10 to 70° C. is sufficient.

A catalyst adsorption step is a step to bring the modified layer of the electroless plating material into contact with a metal compound solution that contains colloid and/or ions. As a result of this step, the colloid or ions of the catalyst metal adsorb to the polar groups that are present in the surface of the modified layer and even in the pores. As the metal compound solution, an alkaline solution that contains metal complex ions and an acidic solution that contains a metal colloid are known, and both types can be used. When an alkaline metal compound solution that contains metal particles with a small diameter is used, the adhesion strength of the plating film is further improved because of its high permeability and high dispersibility into the modified layer. It should be noted that a catalyst metal is a metal that functions as a catalyst for reduction and deposition of metal ions in the electroless plating treatment step. Palladium (Pd), silver (Ag), copper (Cu) and so on are generally known as the catalyst metal.

To bring the modified layer into contact with the metal compound solution, the metal compound solution may be applied to the surface of the modified layer or the resin substrate may be immersed into the metal compound solution. The metal compound solution diffuses from the surface of the modified layer into the interior thereof, and the ions or colloids of the metal compound adsorb to the polar groups. The ions or colloid become fine metal particles of nano-level size by a reduction reaction.

The electroless plating treatment step is a step to form an electroless plating film on the surface of the modified layer after the catalyst adsorption step. In the plating step, the plating metal is deposited on the surface in such a manner that the catalyst metal which has been adsorbed to the modified layer serves as nuclei. While the electroless plating film that is formed is usually a copper plating film that contains copper when the electroless plating material is used for a circuit board, a nickel-based plating film such as Ni plating, Ni—P plating, Ni—B plating, or Ni—W plating film or palladium plating, gold plating, silver plating or cobalt plating film may be formed depending on the usage.

After the electroless plating treatment step, an electrolytic plating treatment step may be further carried out. Since the electroless plating material is not suitable for electrolytic plating because of its Jack of electrical conductivity. After the electroless plating treatment step, however, an electrolytic plating treatment can be carried out on a surface of the electroless plating film. The conditions for the surface cleaning step, the catalyst adsorption step, the electroless plating treatment step and the electrolytic plating treatment step that have been described above are not limited and these steps can be carried out in the same manner as those in conventional plating treatment.

The electroless plating material that is obtained by the method for the production of an electroless plating material according to the present invention is suitable for the fabrication of a printed circuit board. It should be noted that when a circuit board is fabricated, a specific wiring pattern is required to be formed. Thus, various types of plating treatment may be carried out after the formation of a resist. Alternatively, a resist may be formed after a plating film has been formed on the entire surface and then a wiring pattern may be formed by etching.

While an embodiment of the method for the production of an electroless plating material according to the present invention has been described in the foregoing, the present invention is not limited to the above embodiments. The present invention can be implemented in various forms which include changes and/or modifications that can be made by those skilled in the art without departing from the gist of the present invention.

The following examples of the method for the production of an electroless plating material according to the present invention are provided to further describe the present invention.

EXAMPLE 1

An electroless plating materials was fabricated using a resin substrate (150 mm×150 mm×0.1 mm) made of a cycloolefin polymer (COP) resin as a resin material body, and chemical copper plating was then carried out as the electroless plating, thereby obtaining a copper plating coated member. The fabrication procedure is described in detail below.

(Ozone treatment step) An ozone water solution with an ozone content of 40 ppm was filled in a container, and the resin substrate was immersed in the ozone water solution for 15 minutes in a room temperature atmosphere.

(Drying step) The resin substrate was taken out of the ozone water solution and dried in the open air for a while. Then, the resin substrate was kept in a desiccator for 24 hours.

(Superficial layer removal step) An ozone-treated surface of each of the dried resin substrates was irradiated with ultraviolet rays in the air. For the ultraviolet irradiation, a desktop type photo surface processor "PL21-200" and a low-pressure mercury lamp "EUV200GS-14 (200 W)," which are both manufactured by SEN LIGHTS CORPORATION, were used. The minimum distance from the light source to the surface of the resin substrate was fixed at 3 cm, and irradiation was performed at an illumination intensity of 18 W/cm$^2$ for 10 minutes to remove a superficial layer.

(Surface cleaning step) The resin substrate after the ultraviolet irradiation was immersed in a commercially available cleaner conditioner solution that was maintained at 25° C. for 5 minutes. The resin substrate was taken out of the cleaner conditioner solution and washed with water.

(Catalyst adsorption step) The resin substrate after water washing was immersed in a commercially available Pd catalyst solution that had been heated to 50° C. for 5 minutes. Then, to reduce the palladium, the resin substrate was immersed for 5 minutes in a commercially available Pd catalyst reducing solution that had been heated to 30° C.

(Chemical copper plating treatment step) The resin substrate, to which palladium had adsorbed, was immersed in an electroless Cu plating bath that was maintained at 25° C. to allow an electroless Cu plating film to deposit thereon over 10 minutes. The deposited electroless Cu plating film had a thickness of 0.5 μm.

COMPARATIVE EXAMPLE 1

A copper plating coated member was fabricated in the same manner as in Example 1 except that the surface layer removal step was not carried out.

Figure 2:
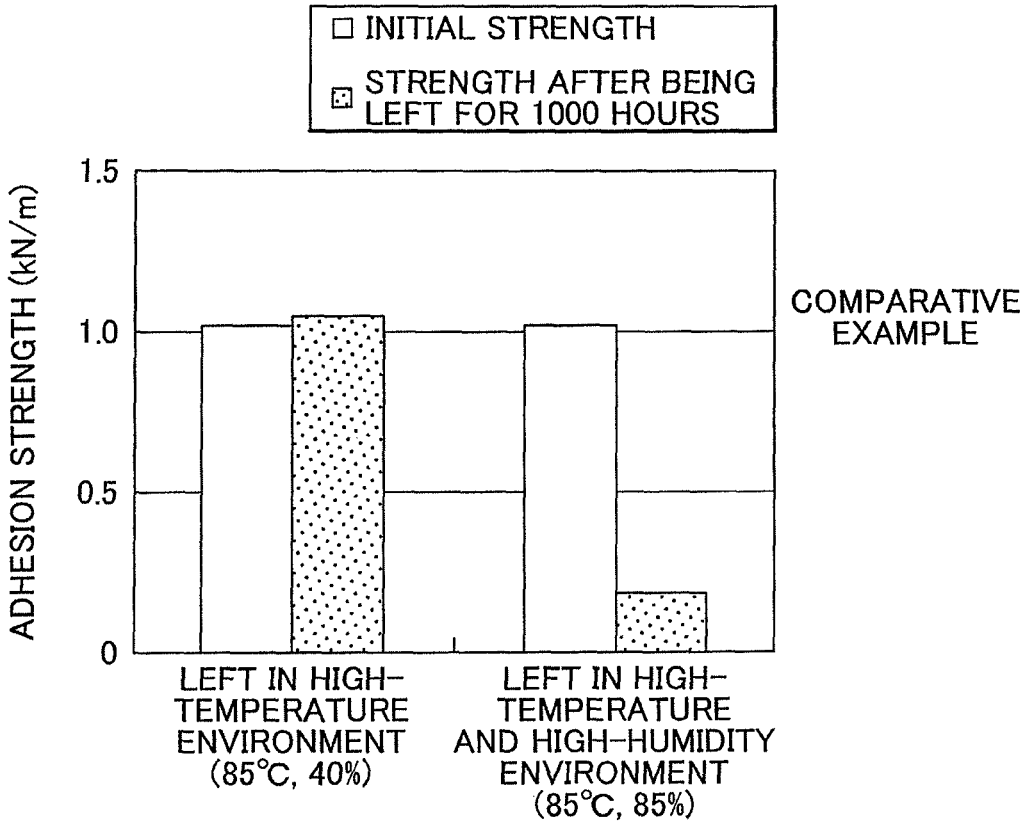
FIG. 2 is a graph that shows the initial adhesion strength of an electroless plating coated member of Comparative Example and the adhesion strength thereof after it has been left to stand in a high-temperature environment.

<Evaluation 1> (1-1) A durability test and a peeling test were conducted to demonstrate that the adhesion strength between the resin substrate and the copper plating film of the copper plating coated member of Comparative Example would decrease when exposed to a high-temperature and high-humidity environment. Thus, the adhesion strength after the durability test was measured. For the measurement of adhesion strength, a tensile tester (autograph) was used. As test samples, the coated member of Comparative Example 1 was used. The durability test was carried out in the following two ways. In the first way, a sample was left to stand in a high-temperature and high-humidity environment of 85° C. and 85% for 1000 hours and, in the second way, a sample was left to stand in a high-temperature environment of 85° C. and 40% for 1000 hours. The humidity here is relative humidity. The adhesion strengths before and after the durability test are shown in FIG. 2.

Figure 3:
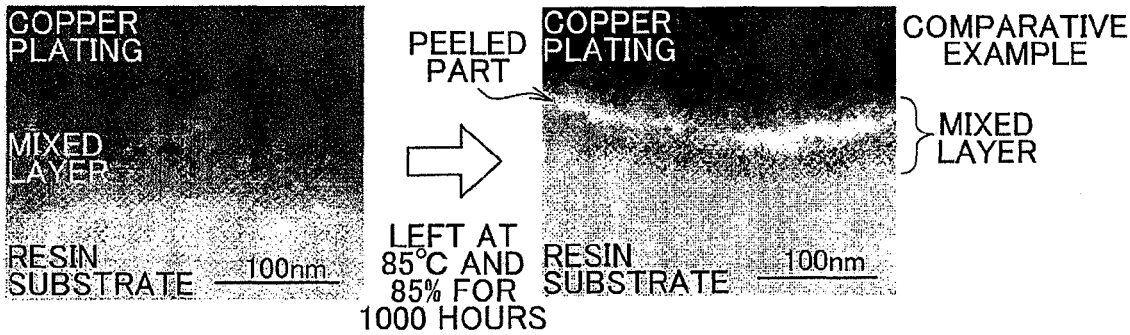
FIG. 3 shows photographs that are substituted for drawings that shows a cross-section of an electroless plating coated member of Comparative Example and a cross-section thereof in which an electroless plating film is peeled off after it has been left to stand in a high-temperature high-humidity in a environment.

The adhesion strength of the coated member of Comparative Example 1 was not decreased in an environment where only the temperature was high. It was, however, found that the coated member underwent a rapid reduction in adhesion strength when left to stand in a high-temperature and high-humidity environment. FIG. 3 shows the results of observation under a transmission electron microscope (TEM) of a cross-section of the coated member of Comparative Example 1 and a cross-section thereof after it was left to stand in a high-temperature and high-humidity environment for 1000 hours and then subjected to measurement of adhesion strength (i.e., the cross-section where peeling occurred). Observation of the cross-section of the coated member of Comparative Example 1 revealed the presence of a mixed layer that was formed by the impregnation of the plating solution into the pores in the modified layer that had been formed on a surface of the resin substrate between the resin substrate and the copper plating. Also revealed is the fact that the peeling of the copper plating after the durability test occurred from the mixed layer. That is, the mixed layer underwent a drastic reduction in strength when left to stand in a high-temperature high-humidity environment.

Figure 4:
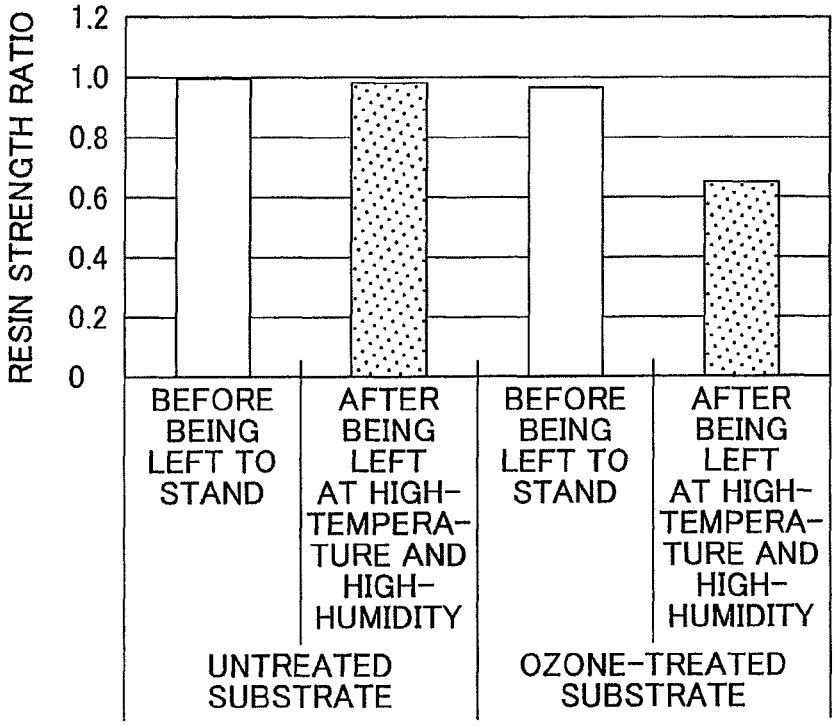
FIG. 4 is a graph that shows the initial surface strengths of an untreated resin material and a resin material that was subjected to an ozone water treatment and the surface strengths thereof after they have been left to stand in a high-temperature high-humidity environment.

(1-2) A durability test was next conducted on resin substrates, and the shear strengths of surfaces of the resin substrates before and after the durability test were measured. For measurement of the strength, a SAICAS method (constant load mode) was used. As samples, an untreated resin substrate, which had not been subjected to the ozone treatment step (untreated substrate), and a resin substrate, which had been subjected to the ozone treatment step but not to the superficial layer removal step (ozone-treated substrate), were used. As the durability test, the samples were left to stand in a high-temperature high-humidity environment of 85° C. and 85% for 1000 hours. The resin strengths before and after the durability test, which are relative to the strength of the untreated substrate before the durability test that is taken as 1, are shown in FIG. 4.

As to the untreated substrate, there is no significant difference in strengths of the resin between before and after the durability test. However, the ozone-treated substrate, which had strength substantially equal to the strength of the untreated substrate before the durability test, underwent a significantly reduction in strength when left to stand in a high-temperature and high-humidity environment. This is likely to be because the modified layer that was formed in a surface of the resin substrate in the ozone treatment step was swollen in a high-temperature and high water content environment.

Figure 5:
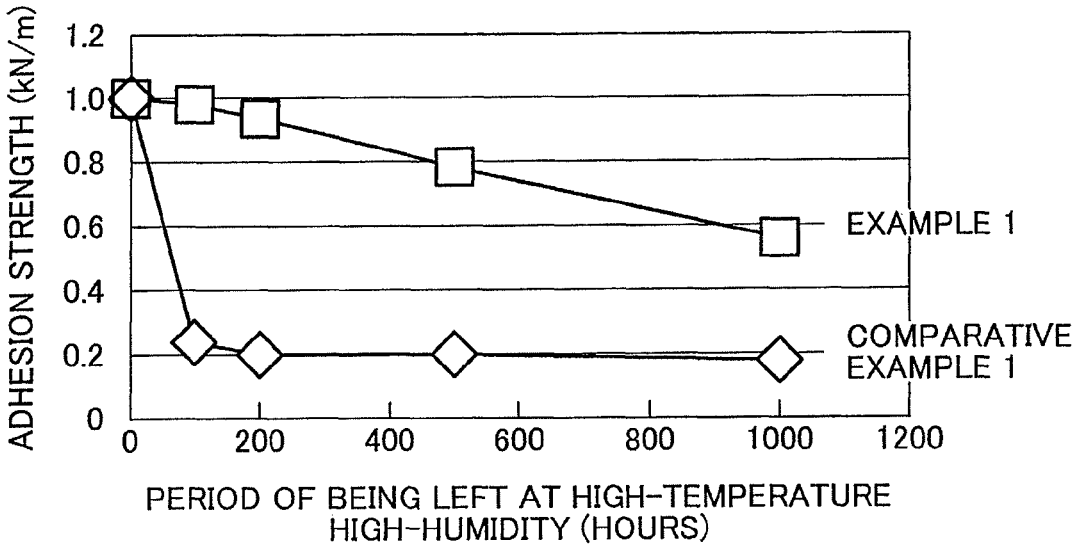
FIG. 5 is a graph that shows the change in adhesion strength with time of an electroless plating coated member that uses an electroless plating material of Comparative Example that was fabricated from a resin material that had been subjected only to an ozone water treatment and that of an electroless plating coated member that uses an electroless plating material of Example of the present invention that was fabricated from a resin material that had been subjected to an ozone water treatment and then to an ultraviolet irradiation treatment.

(1-3) A durability test in a high-temperature and high-humidity environment (85° C., 85%) was conducted on the coated member of Example 1 and the coated member of Comparative Example 1. Then, the adhesion strengths of the coated members that were kept in the high-temperature and high-humidity environment for 100 hours, 200 hours, 500 hours and 1000 hours, respectively, were measured. For the measurement of adhesion strength, a tensile tester (autograph) was used. The results are shown in FIG. 5.

The coated member of Comparative Example 1 underwent a remarkable reduction in adhesion strength only when left to stand for 100 hours. The coated member of Example 1 was able to maintain the adhesion strength before the durability test for approximately 200 hours. It was able to keep approximately 60% of the initial adhesion strength even when the durability test time was longer.

Figure 6:
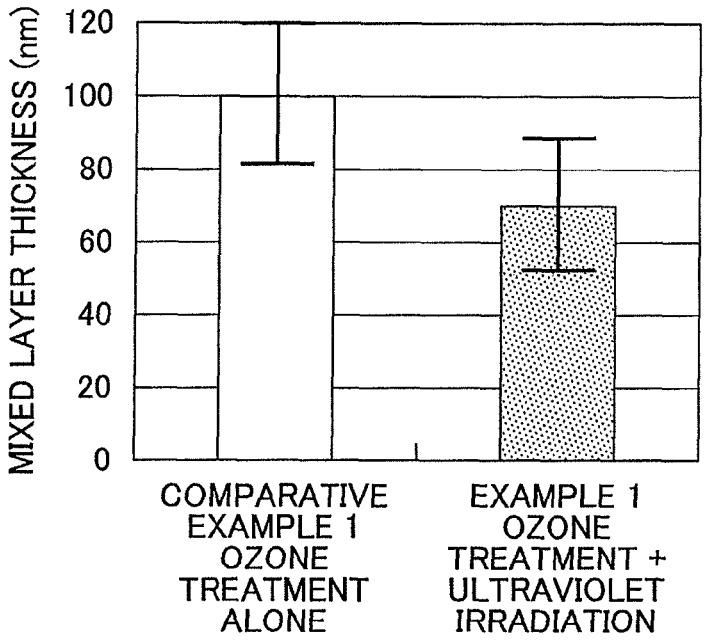
FIG. 6 is a graph that compares the thickness of a mixed layer of an electroless plating coated member that uses an electroless plating material of Comparative Example that was fabricated from a resin material that had been subjected only to an ozone water treatment and that of an electroless plating coated member that uses an electroless plating material of Example of the present invention that was fabricated from a resin material that had been subjected to an ozone water treatment and then to an ultraviolet irradiation treatment.

(1-4) The thickness of the mixed layer in a coated member of Example 1 and that in a coated member of Comparative Example 1 were compared to calculate the thickness of the superficial layer that was removed in the superficial layer removal step. The thickness of the mixed layer was the average of the values that were measured at a plurality of points on a TEM photograph. The results are shown in FIG. 6.

Because the mixed layer of the coated member of Comparative Example 1 had a thickness of 100 nm, the modified layer that was formed in the ozone treatment step was found to have a thickness of 100 nm. Also, the mixed layer of the coated member of Example 1 had a thickness of 70 nm. That is, a superficial layer with a thickness of 30 nm was found to have been removed from the surface of the modified layer in the superficial layer removal step.

Figure 7:
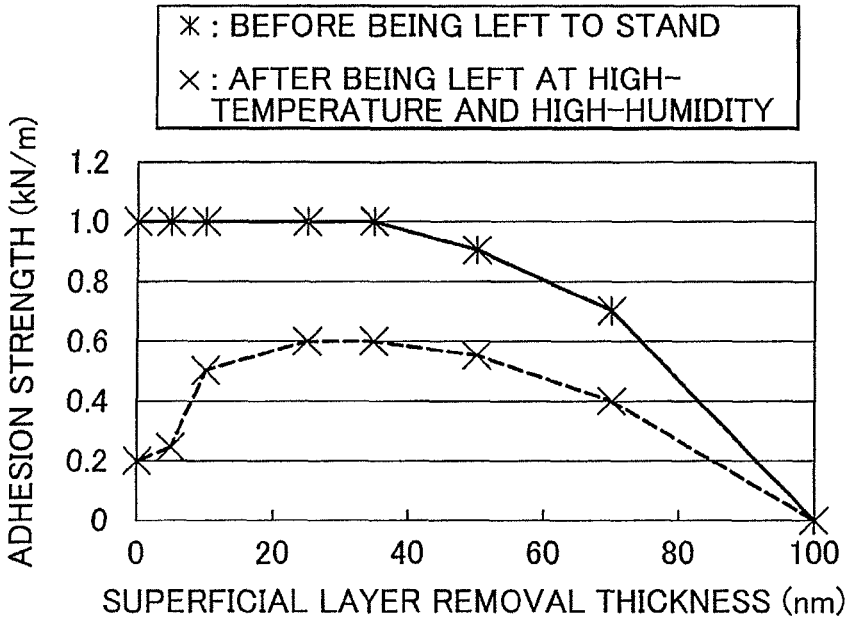
FIG. 7 is a graph that shows the change in adhesion strength, before and after being left to stand for a long time in a high-temperature high-humidity environment, of electroless plating coated members that used electroless plating materials that were fabricated from resin materials that had been subjected to ultraviolet irradiation treatment under different conditions after an ozone water treatment.

<Evaluation 2> The thickness of the superficial layer to be removed was varied by changing the illumination intensity and/or the irradiation time of the ultraviolet rays in the superficial layer removal step of Example 1, thereby obtaining seven copper plating coated members of different types. The steps other than the superficial layer removal step were the same as those in Example 1. TEM observation of the seven coated members revealed that the thickness of the superficial layer removed in the superficial layer removal step (superficial layer removal thickness) was 5 nm, 10 nm, 25 nm, 35 nm, 50 nm, 70 nm, and 100 nm (the modified layer was entirely removed). A durability test in a high-temperature and high-humidity environment (85° C. and 85%, kept for 1000 hours) was conducted on the coated members. The adhesion strengths of the coated members before and after the durability test were measured. For the measurement of adhesion strength, a tensile tester (autograph) was used. The results are shown in FIG. 7. The coated member that had a superficial layer removal thickness of 0 nm in FIG. 7 was the coated member of Comparative Example 1.

When the thickness of the removed superficial layer was 10 to 50 nm, the adhesion strength after the durability test was at least 50% of the adhesion strength before the test. When the thickness of the removed superficial layer was 25 to 35 nm, the adhesion strength after the durability test was approximately 60% of the adhesion strength before the test. It was found that, because the modified layer had a thickness of 100 nm, reduction of the adhesion strength between the resin material and the electroless plating film that occurs in a high-temperature and high-humidity environment can be reduced when the superficial layer is removed up to a thickness that is 10 to 50%, specifically 20 to 40%, more specifically 25 to 35%, of the thickness of the modified layer.

<Evaluation 3> In addition to varying the thickness of the superficial layer to be removed as in Evaluation 2, the ozone concentration and/or immersion time in the ozone treatment step were changed to vary the thickness of the modified layer, there by obtaining various types of copper plating coated members. The thickness of the modified layer and the superficial layer removal thickness of each coated member that were measured by TEM observation are summarized in Table 1.

A durability test in a high-temperature high-humidity environment (85° C. and 85%, kept for 1000 hours) was conducted on these coated members. The adhesion strengths of the coated members before and after the durability test were measured. For the measurement of adhesion strength, a tensile tester (autograph) was used. The results are summarized in Table 1. The types of the material bodies that were used are also shown in Table 1.

In each of the coated members, the adhesion strength was improved when the superficial layer was removed. However, when the superficial layer removal thickness is too small relative to the thickness of the modified layer, the adhesion strength was insufficient after the coated member was left to stand at high-temperature and high-humidity. When the modified layer had a thickness of 30 nm, a coated member that had excellent adhesion strength was able to be obtained when a superficial layer with a thickness of approximately 10 nm was removed. When the modified layer had a thickness greater than 30 nm, a coated member that had excellent adhesion strength was able to be obtained when a superficial layer with a thickness of 0.1 T [nm] or greater, where T represents the thickness [nm] of the modified layer, was removed. It has been found that when the modified layer has a thickness of 60 nm or greater, for example, the range of the superficial layer removal thickness, in which range the adhesion strength of the coated member after standing under a high-temperature and high-humidity environment is at least 50% of that before standing thereunder, is so wide that it becomes easy to control the amount of the superficial layer to be removed.

TABLE 1

| Type of material body | Thickness of modified layer T [nm] | Superficial layer removal thickness [nm] | Evaluation (Adhesion strength after standing under high-temperature and high-humidity is at least 50% of that before standing: Good) |
|---|---|---|---|
| COP resin | 30 | 5 | (Strength after standing is insufficient) |
| | | 10 | Good |
| | | 15 | (Strength before standing is insufficient) |
| COP resin | 70 | 5 | (Strength after standing is insufficient) |
| | | 15 | Good |
| | | 30 | Good |
| | | 50 | (Strength before standing is insufficient) |
| Epoxy resin | 120 | 5 | (Strength after standing is insufficient) |
| | | 15 | Good |
| Epoxy resin | 200 | 10 | (Strength after standing is insufficient) |

In the above embodiment, the irradiation of ultraviolet rays to the surface of the material body as an example of way to remove a superficial layer of the modified layer. However, plasma processing, flame treatment, etching processing using acid solution, etc may be used.

What is claimed is:

1. A method for the production of an electroless plating material, comprising:

an ozone treatment step in which a material body that is made of a resin is brought into contact with a solution that contains ozone to form a modified layer in a surface of the material body;

a drying step in which, after the ozone treatment step, the material body is dried to remove the ozone solution that has adhered to the material body;

a superficial layer removal step in which, after the drying step, the surface of the modified layer is irradiated with ultraviolet rays to remove a thickness of 0.1 T or more and 0.5 T or less thereof, where T represents the thickness of the modified layer; and a plating step in which, after the superficial layer removal step, the surface of the material body is plated by electroless plating.

2. The production method according to claim 1, wherein the ultraviolet rays have a wavelength of 350 nm or less.

3. The production method according to claim 2, wherein the ultraviolet rays have a wavelength of 300 nm or less.

4. The production method according to claim 3, wherein the ultraviolet rays have a wavelength of 150 to 260 nm.

5. The production method according to claim 1, wherein the amount of ultraviolet irradiation is 8 to 22 $W/cm^2$.

6. The production method according to claim 1, wherein the time of ultraviolet irradiation is 1 to 40 minutes.

7. The production method according to claim 1, wherein in the superficial layer removal step, the surface of the modified layer is removed by a thickness of 0.2 T or more and 0.4 T or less, where T represents the thickness of the modified layer.

8. The production method according to claim 7, wherein in the superficial layer removal step, the surface of the modified layer is removed by a thickness of 0.25 T or more and 0.35 T or less, where T represents the thickness of the modified layer.

9. The production method according to claim 1, wherein the modified layer that is formed in the ozone treatment step has a thickness of 30 to 200 nm.

10. The production method according to claim 9, wherein the modified layer that is formed in the ozone treatment step has a thickness of 60 to 200 nm.

11. The production method according to claim 10, wherein the modified layer that is formed in the ozone treatment step has a thickness of 90 to 150 nm.

12. The production method according to claim 1, wherein the superficial layer removal step is carried out in an oxidative atmosphere.

13. The production method according to claim 1, wherein, after the superficial layer removal step, the surface of the material body is treated with at least one of an alkaline component and a surfactant before the material body is subjected to electroless plating.

14. The production method according to claim 1, wherein a catalyst is adsorbed to the material body after the superficial layer removal step.

* * * * *